US006150634A

United States Patent [19]

Haussner et al.

[11] Patent Number: 6,150,634

[45] Date of Patent: Nov. 21, 2000

[54] GLOW PLUG WITH ELECTRONIC COMPONENT FOR SWITCHING BETWEEN HEATING AND ION SENSING FUNCTIONS

[75] Inventors: Michael Haussner, Benningen; Heinz-Georg Schmitz, Kirchberg/Murr; Günter Uhl, Helmstadt-Bargen, all of Germany

[73] Assignee: Beru AG, Ludwigsburg, Germany

[21] Appl. No.: 09/440,265

[22] Filed: Nov. 15, 1999

[30] Foreign Application Priority Data

Nov. 13, 1998 [DE] Germany ..... 198 52 485

[51] Int. Cl.[7] ..... F23Q 7/00

[52] U.S. Cl. ..... 219/270; 219/541; 123/145 A

[58] Field of Search ..... 219/270, 544, 219/541; 123/145 A, 145 R; 361/264–266

[56] References Cited

U.S. PATENT DOCUMENTS 5,893,993 4/1999 Kurano ..... 219/270

5,922,229 7/1999 Kurano ..... 219/270

FOREIGN PATENT DOCUMENTS 10-9113 1/1998 Japan .

10-73070 3/1998 Japan .

10-77945 3/1998 Japan .

*Primary Examiner*—John A. Jeffery

*Attorney, Agent, or Firm*—Nixon Peabody LLP; David S. Safran

[57] ABSTRACT

A glow plug comprises a heating rod with an inner heater coil and optionally at least one control coil, the heating rod being insulated from the glow plug body and is provided with a plug-type or screw terminal for the power supply voltage. Furthermore, the terminal (4) has an electronic component (6), preferably a chip, with a terminal (7) connected to the power supply voltage, a terminal (8) connected to the glow tube (1.3) and a terminal (9) connected to the body (3). The electronic component (6) is designed as a control element for switching the functioning of the glow plug between a heating function and a sensing function for measuring the ion flow in the combustion space area in proximity to the heating rod (1).

10 Claims, 2 Drawing Sheets

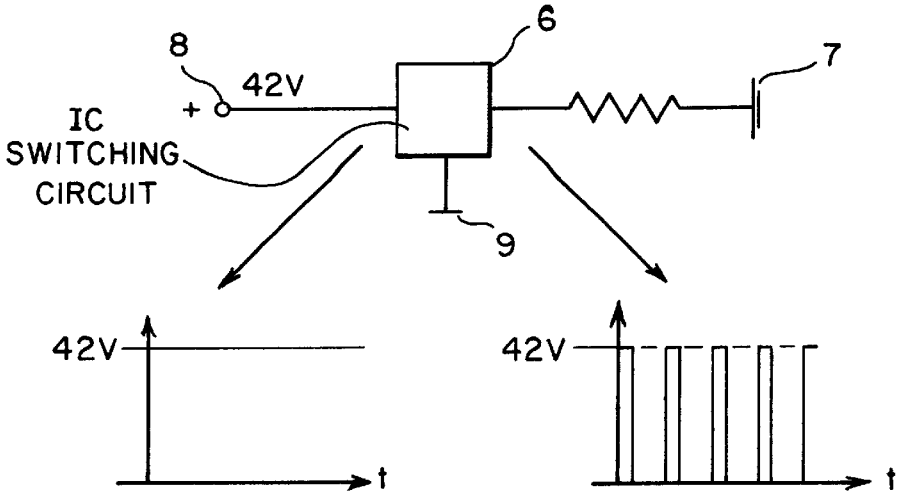
FIG. 3
FIG. 4
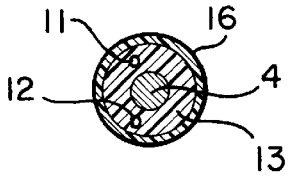
FIG. 5
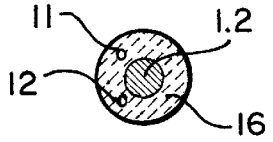
FIG. 6
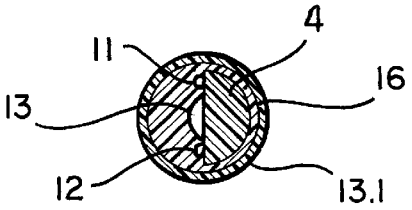
FIG. 7
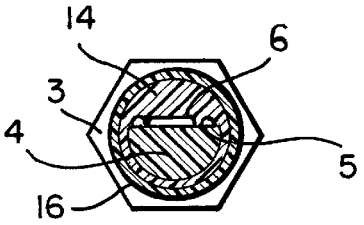

GLOW PLUG WITH ELECTRONIC COMPONENT FOR SWITCHING BETWEEN HEATING AND ION SENSING FUNCTIONS

BACKGROUND OF THE INVENTION

1. Field of the Invention

The invention relates to electrically triggered rod glow plugs for ion flow measurement, cycling and sensor functionalization.

2. Description of Related Art

Operating conventional glow plugs with an external conventional control device is known; in this way, the function of a conventional rod glow plug can be extended above and beyond actual glowing to ion flow measurement and/or to sensor functions, and other terminals, for example, complex plug-type terminals with a multi-pin coaxial connector are necessary for triggering. Consequently, difficulties arise in the laying of the additional lines since, for example, the grounding line of each glow plug must be laid at the same time. In this case, the tight space conditions in the engine compartment make matters more difficult throughout; at the same time, there is the increased danger of the occurrence of contact resistances and of voltage loss due to the necessary length of the cable. Finally, conventional glow plugs with a conventional control device cannot be easily operated on higher voltage (for example, 42 volts) onboard electrical systems.

SUMMARY OF THE INVENTION

A primary object of the present invention is to overcome the above-noted defects of the prior art; in particular, it is a further and more specific object to, in the case of an ungrounded glow plug, for example, for ion flow measurement, to make a ground line back to the control device dispensable.

Likewise, it is a further object to make it possible to operate a glow plug designed for an onboard electrical system voltage of, for example, 14 volts, at an onboard electrical system voltage of, for example, 42 volts, while, at the same time, retaining a conventional glow plug terminal, especially, a single-pin connector system.

It is yet another object to enable use of the current path for operation of the glow plug for relaying sensor signals. In this case, the structure of the glow plug should be such that economical series production on existing systems is possible, special importance accruing to the assembly of similar components with largely the same process while maintaining the cycle time.

These objects are achieved by the glow plug a glow plug in accordance with the present invention in which a plug-type terminal has an electronic component, preferably a chip, with a terminal for connection to the power supply voltage, a terminal for connection to the glow tube and a terminal for connection to the glow plug body, and in which the electronic component is designed as a control element for the functions of the glow plug for heating or for measuring the ion flow in the combustion space-side area of the heating rod.

The glow plug in accordance with the invention differs from conventional glow plugs in that an electronic component is integrated in the new glow plug in which circuits of the most varied type can be implemented. By these electronics integrated in the plug, for example, in the application as an ion flow plug (insulated structure between conventional heating rod and engine mass; for example, the cylinder head), the ground return to the control device which is otherwise necessary for operation can be eliminated by the decision being rendered about the existing voltage whether a measurement is to be taken (insulation with respect to ground) or glow operation is desired (bridging of the insulation within the glow plug and thus the ground connection).

Moreover, using the integrated circuit, for example, also periodic switching-through or blocking of the current path can take place, for example, to operate a glow plug designed, for example, for 11 V operating voltage or a heating/control element designed for this voltage even at higher onboard electrical system voltages. A voltage is then generated by the periodic switching which corresponds in its effective value with respect to the rated operating voltage of the design.

Furthermore, for example, a circuit can also be built such that a sensor integrated into the glow plug can be supplied via the same supply terminal of the heating or control elements or the measurement signal can be tapped.

BRIEF DESCRIPTION OF THE DRAWINGS

FIG. 3 is a circuit diagram for cycling;

FIGS. 4, 5, & 6 are cross-sectional views taken along lines 4—4, 5—5, and 6—6 of FIG. 1; and FIG. 7 is a cross-sectional view taken along line 7—7 of FIG. 2.

DETAILED DESCRIPTION OF THE INVENTION

Figure 1:
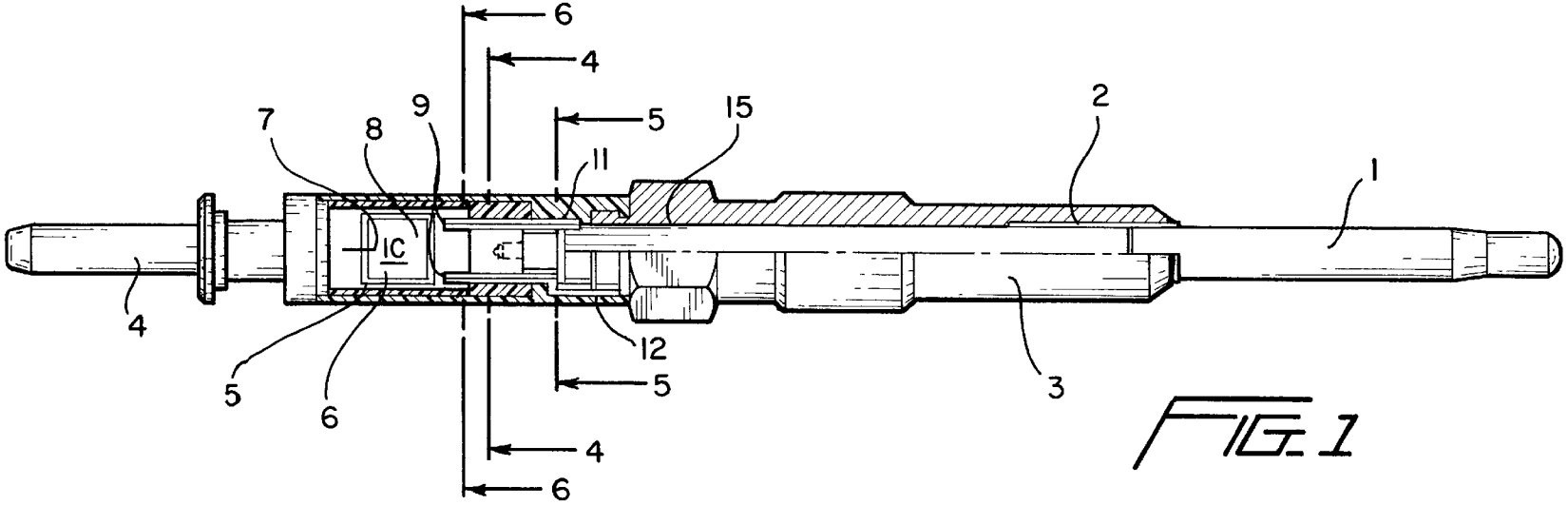
FIG. 1 a schematic partial longitudinal cross-sectional view of a preferred embodiment of a glow plug in accordance with the invention.
Figure 2:
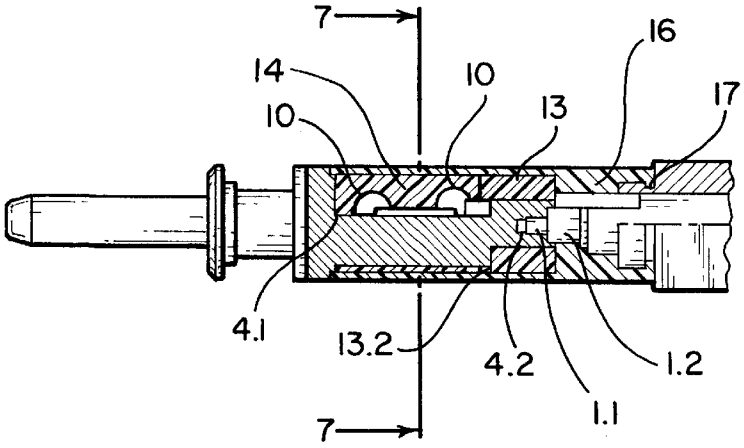
FIG. 2 is a partial longitudinal cross-sectional view of a plug-type terminal in accordance with the invention, rotated 90° about its longitudinal center axis relative to the view in FIG. 1.

In the following, a glow plug with insulation between the heating rod and the engine mass, for example, for use for ion flow measurement, is described using the figures; the heating rods known previously are suitable as the heating rods, for example, those with a metal glow tube or with a glow tube (at least partially) of conductive ceramic and the like.

The heating rod 1 can be produced on existing series facilities; this also applies to the pin 1.1 which establishes the later contact to the plug-type terminal 4.

The heating rod 1 can be pressed into the body 3, as in the past. The insulating layer 2 can either be applied to the body 3 or to the heating rod 1. This unit can be mounted completely automatically and checked for operation.

The insulating tube 15 is used as a shock guard and as a buffer for the extrusion coating mass 16 and is pressed as the next working step between the heating rod and the body. The material is preferably temperature-resistant plastic.

The plug-type terminal 4, in the terminal area, is identical to existing designs. Accordingly, it has a threaded or unthreaded connector pin on the terminal side. In the front area, the plug-type terminal 4 has a recess as an installation platform 4.1 for the ceramic carrier 5 on which the electronic component 6 is premounted. These two components, together, are applied to the plug-type terminal in the area of the installation platform 4.1, preferably by cementing. As another unit, the current busses 11, 12 can be extrusion coated with a plastic housing 13 and pressed onto the plug-type terminal 4 as a complete unit. So that the unit can be mounted in the correct position, there are an anti-rotation element 13.1 and a lengthwise stop 13.2.

The terminals on the electronic component, for example, the supply voltage terminal 7, the terminal to the glow tube 8 and ground terminal 9, are preferably connected using a bonding process to the respective contact parts of the plug-type terminal 4, current bus for the glow tube 11, and the current bus to the body 12.

This unit is now potted, for example, with a resin 14 for stabilization.

This completed component, the connector 4 with electronics, etc., can be delivered as a bulk component for final installation.

The plug-type terminal 4 has a hole 4.2 in the axial direction in which the pin 1.1 of the heating rod is pressed and establishes electrical contact to the inner pin 1.2 of the heating rod 1.

Furthermore, the current bus 11 is connected to the glow tube 1.3 and the current bus 12 is connected to the body 3.

This unit, the heating rod 1 with the body 3 and the plug-type terminal 4, is inserted into an injection tool and an extrusion coating 16 applied, for example, with PA 6.6.

The peripheral groove 17 on the body 3 is used as an additional positive locking for more reliable application of force to the extrusion coating 16.

EXAMPLE 1

Ground contact-making in glow operation of a glow plug with electrically insulated heating rod for ion flow measurement:

Providing, besides the current feed line (positive contact), also the ground line back to the control device or to another ground point for operation of a glow plug with insulated heating rod is known. This means essentially twice the cabling cost with the corresponding losses and fault possibilities.

The glow plug in accordance with the invention can now decide, for example, using integrated electronics based on the existing voltage on the terminal whether glow operation is desired (the existing voltage, for example, less than 16 V) or whether an ion flow is to be measured (existing voltage, for example, greater than 20 V). In the case of glow operation, then, the electronics briefly switches, for example, the glow tube into connection with the glow plug body to create the short circuit to ground which is necessary for operation. In the other case of ion flow measurement, this connection is separated so that the part which projects into the combustion space of the engine is electrically insulated from it, and thus, can function as an electrode. The flowing current (for example, via the glow plug and the ions in the combustion space to the ground, for example, the cylinder head) can be tapped via the same terminal in the control device and can be further processed as the measurement signal.

EXAMPLE 2

Operation of a heating element designed for a certain voltage at a higher voltage.

By means of the integrated electronics, an existing voltage can be cycled by periodic switching so that the effective value of the output voltage corresponds to the rated voltage of the glow plug. In this way, re-design for higher voltages is unnecessary. This has the further advantage that the smaller cross sections necessary otherwise for glow elements designed for higher voltages which have an adverse effect on the service life of the glow plugs can be avoided (FIG. 3).

EXAMPLE 3

Alternating application of a sensor signal and the operating voltage to the glow plug terminal.

By means of the integrated electronics, the signal of a sensor integrated into the glow plug can be placed on the terminal for operation of the glow plug, with which a separate terminal is avoided. For intermittent measurement/operation, for example, the cases can be distinguished similarly to those described in Example 1.

In other preferred embodiments, the system comprised of the glow plug electronics 6, and plug-type terminal 4 is made modular. On the one hand, a plug-type terminal 4 with integrated electronics 6 can be made for mating the glow plug body 3 with the heating rod 1 (two-part design). On the other hand, the electronic component 6 with a clip-on terminal for connection to the plug-type terminal 4 and a clip-on terminal for connection to the glow plug body 3 can be provided with a heating rod 1 and can be connected to the heating rod 1 for mating with the plug-type terminal 4 and the body 3 (three-part version).

By the integration of the control electronics into the glow plug according to the invention, the initially enumerated defects of the prior art are overcome. The connector concept of the invention allows automatic series production on existing systems and the individual components can be produced in bulk form; this is advantageous for mass production and storage. By avoiding additional lines, the system in accordance with the invention is less fault-susceptible, especially contact resistances and voltage losses due to cable length being avoided. At the same time, the standard dimensions of glow plugs (jaw size) are not exceeded so that no special tools are necessary for glow plug installation; the glow plugs according to the invention can also be operated on control devices without ion flow electronics.

We claim:

1. A glow plug comprising a glow plug body, a glow tube, a heating rod with inner heater coil, the heating rod being insulated from the glow plug body, and a power terminal for connection to a power supply voltage source; wherein the power terminal has an electronic component with a first terminal for connection to the power supply voltage source, a second terminal for connection to the glow tube and a third terminal for connection to the glow plug body; and wherein the electronic component is a control element which controls functioning of the glow plug as a heater and as a sensor for measuring ion flow in a combustion space area which, in use, is in proximity to the heating rod.

2. The glow plug as claimed in claim 1, wherein the terminal has an installation platform on which the electronic component is fixed on a ceramic carrier.

3. The glow plug as claimed in claim 1, wherein the second terminal is connected via a current bus to the glow tube; and wherein the body terminal is connected via a current bus to the glow plug body.

4. The glow plug according to claim 3, wherein the electronic component has a switching circuit which connects the glow tube to the glow plug body for producing a short circuit to ground and which breaks said connection in accordance with whether the glow plug is to function as a heater or a sensor, at any given point in time.

5. The glow plug as claimed in claim 1, wherein the power terminal is a plug-type terminal and has an axial hole into which a pin of the heating rod is received, thereby establishing electrical contact with an inner pin of the heating rod.

6. The glow plug according to claim 1, wherein the glow plug further comprises at least one control coil.

7. The glow plug according to claim 1, wherein the electronic component is an integrated circuit chip.

8. The glow plug according to claim 1, wherein the power terminal is a plug-type terminal.

9. Plug-type terminal for a glow plug, comprising an electronic component with a terminal for connection to the power supply voltage, a terminal for connection to the glow tube and a terminal for connection to a body of the glow plug, wherein the electronic component is a control element for switching functions of the glow plug, in use, between a heating function and a sensing function for measuring ion flow in a combustion space area.

10. Plug-type terminal according to claim 9, wherein the electronic component is an integrated circuit chip.

* * * * *